US006293536B1

(12) United States Patent
Boehmer et al.

(10) Patent No.: US 6,293,536 B1
(45) Date of Patent: Sep. 25, 2001

(54) PAPER FEEDER FOR A SINGLE SHEET PRINTER

(75) Inventors: Georg Boehmer, Munich; Joseph Dietl; Hans Hahn, both of Unterhaching; Bernward Heller, Kirchheim; Hubert Mugrauer, Zorneding; Otto Olbrich, Taufkirchen; Reinhold Rigauer; Otto Rotheimer, both of Erding; Rudolf Seeberger, Lochham, all of (DE)

(73) Assignee: Qce Printing Systems GmbH, Poing (DE)

( * ) Notice: Subject to any disclaimer, the term of this patent is extended or adjusted under 35 U.S.C. 154(b) by 0 days.

(21) Appl. No.: 09/284,919

(22) PCT Filed: Oct. 20, 1997

(86) PCT No.: PCT/DE97/02428

§ 371 Date: Jun. 8, 1999

§ 102(e) Date: Jun. 8, 1999

(87) PCT Pub. No.: WO98/17572

PCT Pub. Date: Apr. 30, 1998

(30) Foreign Application Priority Data

Oct. 22, 1996 (DE) ..... 196 43 640

(51) Int. Cl.[7] ..... B65H 3/44; B65H 5/26

(52) U.S. Cl. ..... 271/9.11; 271/9.12; 271/9.13

(58) Field of Search ..... 271/9.01, 9.11, 271/9.12, 9.13, 288, 289, 290

(56) References Cited

U.S. PATENT DOCUMENTS

| | | | | |
|---|---|---|---|---|
| 4,066,253 | | 1/1978 | Lundbald et al. . | |
| 4,515,458 | * | 5/1985 | Masuda et al. | 271/289 |
| 4,530,593 | * | 7/1985 | Kasuya et al. | 271/288 |
| 4,711,444 | | 12/1987 | Geurts . | |
| 5,013,027 | * | 5/1991 | Futukawa | 271/290 |
| 5,203,552 | | 4/1993 | Hoshi et al. . | |
| 5,248,136 | | 9/1993 | Hamanaka . | |
| 5,253,028 | * | 10/1993 | Gordal et al. | 271/9.12 |
| 5,407,192 | * | 4/1995 | Ueda et al. | 271/289 |

FOREIGN PATENT DOCUMENTS

| | | | | |
|---|---|---|---|---|
| 34 06 626 A1 | | 2/1984 | (DE) . | |
| 34 20 667 A1 | | 6/1984 | (DE) . | |
| 40 26 056 C2 | | 8/1990 | (DE) . | |
| 0 702 276 A2 | | 9/1995 | (EP) . | |
| 363171727 A | * | 7/1988 | (JP) | 271/9.12 |
| 402198940 A | * | 8/1990 | (JP) | 271/9.13 |
| 404003741 A | * | 1/1992 | (JP) | 271/9.13 |

OTHER PUBLICATIONS

Patent Abstracts of Japan Application No. 3–25117 filed Jan. 28, 1991.

"Expandable Feeder Module", *Xerox Disclosure Journal*, vol. 18 (1993) Nov./Dec., No. 6.

* cited by examiner

*Primary Examiner*—H. Grant Skaggs
(74) *Attorney, Agent, or Firm*—Schiff Hardin & Waite

(57) ABSTRACT

A printer or copier has a paper feeder provided with a plurality of compartments which hold paper for feeding the paper to the printer and a circuit to control conveying of the paper to the printer. The paper feeder includes a drive to move the paper from the paper compartments to a conveying path where it is carried to the printer. A branching portion is provided in the conveying path. Further paper feeders may be connected in series to the first paper feeder, each paper feeder having a plurality of paper compartments and feeding the paper out of a lower paper feed path to the next paper feeder device.

12 Claims, 1 Drawing Sheet

PAPER FEEDER FOR A SINGLE SHEET PRINTER

The present invention is directed to a paper feeder for a single sheet printer. The invention is also directed to an additional paper output as well as the common arrangement thereof together with a paper feeder.

BACKGROUND OF THE INVENTION

In larger single sheet printers of a type which my be encountered in nearly all offices, a paper feeder includes a paper output having a plurality of compartments, for example four compartments, with acceptance capacities of, for example, 500 through 2000 sheets that can be selected via a controller. Differently colored sheets of paper having different pre-printed and different formats, for example, as forms, can thus be stacked in the individual compartments, and are retrieved as desired. Due to the low number of compartments, however, the different sheets of paper available for selection is limited.

Several or all of the can also be filled with the same flat paper and can be selectively driven respectively after emptying the preceding compartment, so that the capacity of the single sheet printer exceeds that of a single compartment in this way. The total capacity, however, is limited to a few thousand sheets of paper in any case.

What is referred to here as "a sheet of paper" is any printable, cut web; it is usually composed of paper but, for example, could also be composed of printable and adequately heat-resistant plastic.

Since refilling the compartments with paper sheets is time-consuming, one aim is to increase the capacity of the compartments. Further, a present job may possibly be interrupted by the refilling operation which may, potentially cause a fault in the print job.

Single sheet printers having an original document storage are also known that automatically print a preselectable number of copies for every sheet of the original, these copies in turn being sorted at the output. It can occur that a single print job requires a multiple refilling of the compartments.

Due to intensifying market trends toward higher functionalities in printers such as, for example, print of jobs with different papers, personalized printing matter with preprinted color applications and the like, the number of input compartments is still not adequate given currently available paper output means.

Additionally, manual interventions in the printing operation by the operating personnel are therefore either required to a greater extent or a correspondingly dimensioned, automatic sheet feeder unit, referred to as a feeder, must be provided, but this also has only a limited capacity. Due to ever-increasing advances into what is referred to as the POD segment (printing on demand), the demands with respect to the individual job sizes are also becoming more stringent.

In some fields, moreover, so many different sheets of paper are printed that, preceding many printing procedures, it is necessary to first remove the paper located in one of the compartments and introduce a different paper. A frequent change in the existing paper input compartments is also necessary, this in turn resulting in a high handling outlay.

In addition to this, the paper which has been removed is often no longer properly stored but often simply placed aside in such a way that it can be damaged in that, for example, some sheets are crumpled. When such sheets are subsequently reintroduced into a compartment of the printer, a paper jam can occur or, on the other hand, a printed copy that does not meet the gualdy demands is output.

It would also be possible to equip the single sheet printer with a paper output means that is larger in conformity with the print volume requirements either from the very outset or by way of retrofitting, this paper output means having many having compartments or compartments of a larger paper acceptance capacity. Insofar as new devices are equipped with an enlarged paper output means that many customers do not need, they are too expensive for these customers; the same is true of that case wherein many different single sheet printers are offered with different paper acceptance capacity since the number of units of every individual printer would be too low in this case.

Retrofitting offers possibility that a single sheet printer can grow along with the print volume requirements; however, retrofitting also generally involves considerable work outlay. Additionally, the previous paper output means which has been replaced by retrofitting is usually no longer usable, so that the retrofitting as well being time-consuming overall is also very cost-intensive.

Various paper feeder means to which further paper output devices can be connected are known for increasing the capacity of processing devices such as printers or copiers. Thus, Xerox Disclosure Journal, Volume 18, No. 16, Nov. 16, 1996, page 617, writes [sic] an expandable paper feeder means for a printer that has a paper output means with a plurality of separately drivable sheet deliveries in which the single sheets to be printed are kept on hand. One of the sheet deliveries is directly connected to the printer independently of the other sheet deliveries and can be replaced by an independent conveyor means to which an additional paper output device can be connected.

U.S. Pat. No. 5,203,552 discloses a paper feeder means for a single sheet copier that has an upper paper output device with two compartments for keeping single sheets on hand as well as a lower paper output device with a further compartment for single sheets. A shunt, to whose two branches the two paper output devices and [sic] are connected is provided in the single sheet copier. The two paper output devices can be optionally driven by the single sheet copier. In order to increase the capacity of the single sheet printer, the lower paper output device additionally has a separate conveying path that is likewise connected to the shunt and to which an additional paper output device can be optionally connected.

Given this known paper feeder means, two separate acceptance points that are merged in the shunt are fashioned at the single sheet copier for the two paper output devices, so that the copier must be designed in a correspondingly involved manner. Further, each paper output device must be individually driven and the conveyor devices provided in the shunt must be designationally activated or, respectively, deactivated, as a result whereof the control outlay of the copier is likewise increased. Further, the separate conveying path for the additional paper output device formed in the lower paper output device is not merged with the actual conveying path of the lower paper output device until inside the copier. At the interface to the lower paper output device, consequently, the shunt is connected both to the conveying path of the lower paper output devices as well as to the separate conveying path of the additional paper output device and must thus be fashioned in a correspondingly involved manner.

An object of the invention is to specify a paper feeder means that is simply constructed and to which additional paper output devices can be connected without great outlay.

This object is achieved by a paper feeder means having the features according to patent claim 1.

In the invention, the paper output device of the paper feeder that has only a single conveying path with which it is connected to the single sheet printer, so that the interface to the paper output device fashioned at the printer can be correspondingly simply fashioned. For connecting the single sheet printer to an additional paper output device, the conveying path in the first paper output device has a branching portion that leads to a paper sheet acceptance station to which the additional paper output device can be connected. The additional paper output device quasi-represents only a further compartment for the acceptance of single sheets that is connected to the single sheet printer by the conveying path of the first paper output device and the branching portion. Further, the control of the paper output is simplified by this type of paper delivery since only the sequence and the point in time of the output of further paper sheets but not the merging of the various paper sheets has to be controlled.

Such a branching portion can be manufactured with little outlay, this also not having a noteworthy influence on the costs of a basic apparatus that is generally composed of a single sheet printer and a standard paper output means attached thereto. An additional paper output means having a suitable capacity can then be connected to the paper sheet acceptance station without, however, the already existing paper output means becoming superfluous and having to be replaced; on the contrary, this continues to be operated in the usual way.

According to a preferred development of the invention, such an additional paper output means is implemented such that it corresponds in terms of capacity and structure essentially to the paper output means provided at the single sheet printer and thus also comprises at least one compartment for the acceptance and output of paper sheets activatable by being driven and comprises a conveying path provided in the additional paper output means, which is referred to below as module conveying path. Via the a module conveying path, a paper sheet is conveyed from the compartment after the drive thereof to a paper sheet output station of the additional paper output means that is connectable to the paper acceptance station of the paper output means that precedes the single sheet printer.

Since the additional paper output means thus exhibits essentially the same structure as the paper output means provided at the single sheet printer, the output devices are manufactured largely of the same component parts and are thereby structurally identical to the farthest-reaching extent in view of every structural embodiment. Further, the compartments also have the same capacities as a result thereof; given, for example, four compartments, the two upper compartments can each respectively accept 2000 sheets and the two compartments lying therebelow can, for example, each accept 500 sheets.

Given employment of only one additional paper out means, the plurality of differently possible compartment arrangements can thereby be doubled. Given the assumption of a DIN A4 format mode and of a normal printing mode, for example, with a processing speed of 0.337 m/s, an operating time of two hours can be achieved without further ado without the operating personnel having to intervene.

According to a further development of the invention, the module conveying path in the additional paper output means also comprises a branching portion that leads to a paper sheet acceptance station that is likewise provided in the module; a further, additional paper output means that is likewise to be implemented structurally the same can follow this paper sheet acceptance station.

In this way, one can forgo offering different auxiliary devices since an arbitrary plurality of modules can be connected in series in order to yield the required number of compartments and, thus, the required overall capacity.

In order to make the conveying path from the respective compartment up to the single sheet printer as short as possible and to thereby see to it that a sheet fetched from the compartment arrives at the printer as soon as possible, it is advantageous according to a further, preferred development of the invention that the paper sheet output station of the paper output means and the paper sheet acceptance station of each and every module are directly connected to one another via a continuous conveying path into which the module conveying path discharges.

When, accordingly, paper is fetched from a compartment of a rear module, it then passes the preceding modules via continuous conveying paths on the shortest route. The corresponding conveying path of each module can, if necessary, even be uncoupled from the module conveying path if, for instance, the appertaining module happens to be faulty or should be repaired.

With only one or a few additional modules, it is thus possible to offer a great multitude of forms, pre-prints, personalized printing material with pre-printed color applications and the like that can be optionally called for printing without an operator having to intervene in any way whatsoever.

In specific applications, thus, for example, when producing brochures or publications with a large number of pages, a greater number of additional paper output means can thus definitely be connected following one another.

The invention, however, relates not only to the paper feeder means described above or to the separate, additional paper output means described above but is also preferably expressly composed of an arrangement of these two means, whereby the paper output station of an additional paper output means is connected to the paper sheet acceptance station of the paper output means attached to the single sheet printer or, preferably, a plurality of additional paper output means are connected in series.

The individual modules can be implemented such that they can be flanged to one another, so that the paper output station of the following modules is directly connected to the paper acceptance station of the preceding module.

Preferably, however, the modules are erected at a slight spatial distance from one another such that an addition or removal of a module by the operating personnel is possible without further ado. In larger companies, for example, some modules can be kept on hand and, as required, can also be temporarily utilized where they are required. The conveying paths can thereby be freely accessible, this having the advantage that a person can be convinced of the proper operation of the system without further ado.

According to a preferred development of the invention, however, a flat connecting tunnel through which the conveying path proceeds is arranged between a paper sheet acceptance station of the paper output means of a single printer or of a paper sheet acceptance station of a module and the following paper sheet output station thereof. As a result of this connecting tunnel, the conveying path is protected against contamination and damage and it can simply be put in place onto the conveying path.

The inventive arrangement preferably comprises a controller with which every compartment can be individually driven or a plurality of compartments can be successively driven, so that only the paper sheets from the currently driven compartment are conveyed to the single sheet printer. The controller can also preferably be integrated in the single sheet printer from the very outset.

However, it is also possible to equip each module with a separate controller; in this case, for example, the single sheet printer can deactivate the compartments in the paper sheet output means preceding it and can simultaneously activate the conveying path branching portion, so that paper sheets are taken from the additional paper output means and, thus, are delivered from the outside and can be supplied into the single sheet printer.

In an embodiment, the present invention provides a paper feeder for a single sheet printer that comprises a paper output device comprising at least one paper compartment and a first conveying path. The paper compartment comprises a drive mechanism for delivering a sheet of paper to the first conveying path. The first conveying path conveys the sheet of paper to the single sheet printer. The conveying path is connected to a first branching which, in turn, is connected to a first paper acceptance station. The first paper output device is connected to a second paper output device at the first paper acceptance station. The second paper output device comprises at least one paper compartment. The paper compartment of the second output device comprises a drive mechanism for delivering a sheet of paper to the first paper acceptance station.

In an embodiment, the second paper output device comprises a module conveying path for receiving the paper sheet from the paper compartment of the second paper output device. The module conveying path is connected to a paper sheet delivery station that is connected to the first paper acceptance station.

In an embodiment, the module conveying path is connected to a throughput path. The throughput path connects the paper sheet delivery station to a second paper acceptance station. The second paper output device is connected to a third paper output device at the second paper acceptance station.

In an embodiment, the paper feeder comprises a fourth paper output device connected to the third paper output device.

In an embodiment, the paper feeder further comprises a flat connecting tunnel disposed between the paper sheet delivery section and the first paper acceptance station. The flat connecting tunnel connects the paper sheet delivery section to the first paper acceptance station.

In an embodiment, the paper feeder further comprises a controller for activating and deactivating the drive mechanisms of the paper compartments of the first and second paper output devices.

In an embodiment, the present invention provides a method of equipping a single-sheet printer with multiple paper feeders that comprises the steps of providing a first paper output device comprising at least one paper compartment and a first conveying path, the paper compartment comprising a drive mechanism for delivering a sheet of paper to the first conveying path, the first conveying path for conveying the sheet of paper to the single sheet printer, the conveying path being connected to a first branching, the first branching being connected to a first paper acceptance station, providing a second paper output device at the first paper acceptance station, the second paper output device comprising at least one paper compartment, the paper compartment of the second paper output device comprising a drive mechanism for delivering a sheet of paper to the first paper acceptance station, the second paper output device further comprises a module conveying path for receiving the paper sheet from the paper compartment of the second paper output device, the module conveying path being connected to a paper sheet delivery station that is connected to the first paper acceptance station, connecting the first conveying path of the first paper output device to the printer, and connecting the module conveying path of the second paper output device to the first paper acceptance station of the first paper output device.

Other objects and advantages of the present invention will become apparent from reading the following detailed description and appended claims, and upon reference to the accompanying drawings.

Figure 1:
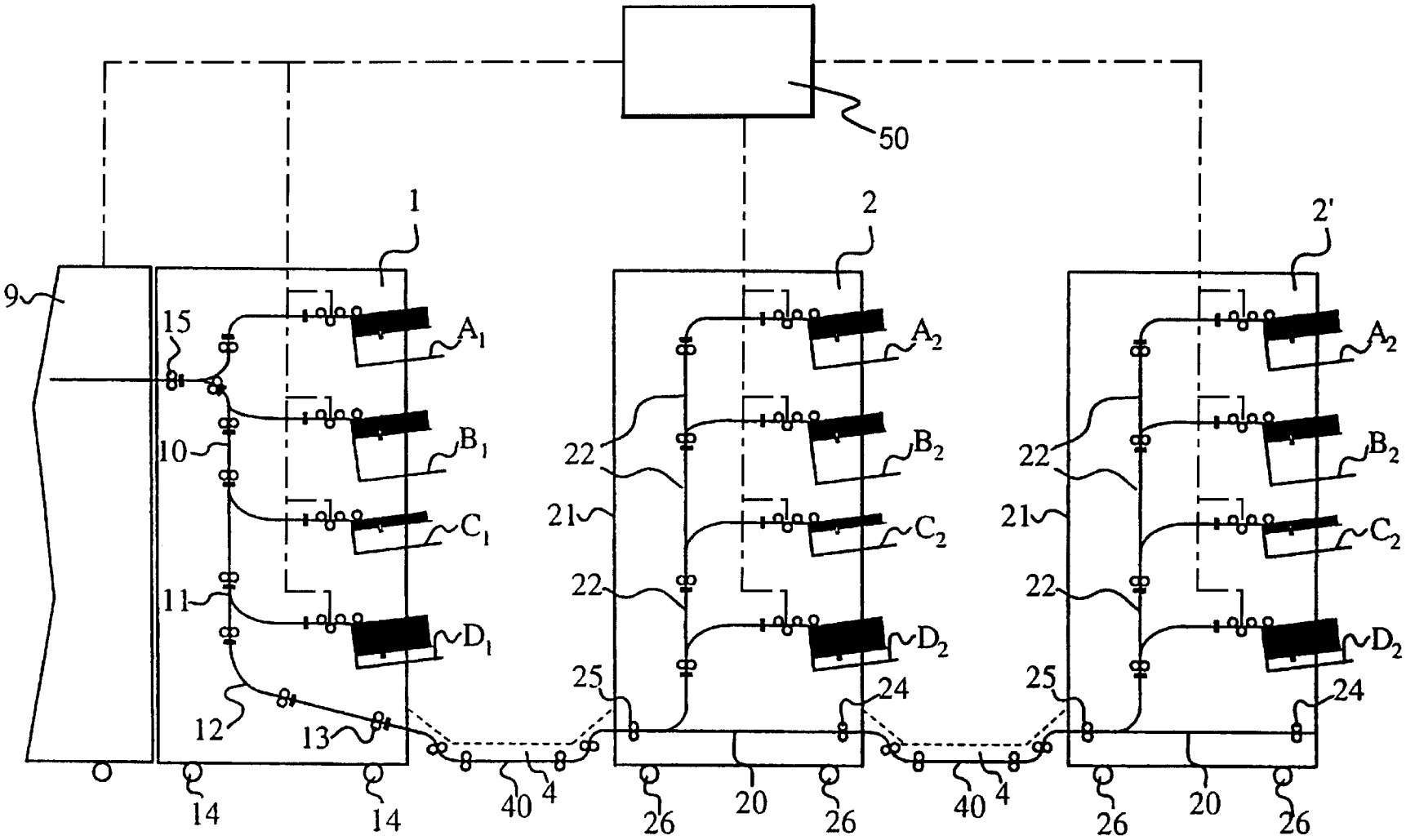
FIG. 1 is a schematic illustration of a paper feeder made in accordance with the present invention that includes three paper output devices linked together.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

A paper output means 1 which outputs paper to a printer input is provided at the back side of a single sheet printer 9 (only schematically indicated), this paper output means 1 comprising four paper sheet compartments $A_1$ through $D_1$ lying above one another whereof the two upper compartments, namely $A_1$ and $B_1$ are designed for the acceptance of, for example, respectively 2000 sheets each and the two lower compartments, namely $C_1$ and $D_1$, are designed for the acceptance of, for example, respectively 500 sheets each.

Each of the compartments Athrough D, which is equipped with a drivable means for removing the respectively uppermost sheet, is connected to a conveying path 10 that connects the outputs of the four compartments $A_1$ through Dto a paper delivery station 15 proceeding wherefrom the individual paper sheets are input into the single sheet printer 9.

The conveying path 10 comprises a branching portion 11 that leads via an intermediate conveying path 12 which is deflected by 90° C. to the outside of the paper output means 1; paper sheets introduced from the outside can be forwarded via the intermediate conveying path 12 and the branching location 11 into the conveying path 10 and can be forwarded from the latter via the paper delivery station 15 into the single sheet printer 9.

Two additional paper output means 2 and 2' precede the above-described single sheet printer $C_1$ and with the following paper output means 1, these two additional paper output means 2 and 2' comprising the same arrangement of respectively four compartments $A_2$ through $D_2$ and a conveying path 22 connected thereto as the paper output means 1, with the difference being that conveying on the conveying path 22 is only in a downward direction, whereas conveying at the lower part of the conveying path 10 is upward.

At its underside, each additional paper output means 2 or, respectively, 2' is fashioned as a module which includes a through conveying path 20 that forms a paper output station 25 at one side of the housing 21 of each module 2 and forms a paper acceptance station 24 at the opposite side. The conveying path 22 in every module 2, coming from above, discharges into the through conveying path 20.

The second module 2' is connected to the first module 2 and the latter is connected to the paper output means 1 by a respective conveying path 40 lying below that is preferably covered by a tunnel 4. Further modules 2 can be connected to what is the module 2' shown at the rear at the right side in the drawing.

As can be seen from the drawing, the paper from the respective compartment can be supplied malfunction-free into the single sheet printer 9 by activating one of the compartments $A_1$ through $D_1$ or, respectively, $A_2$ through $D_2$ in the illustrated arrangement (and by deactivating all other compartments).

The modules 2 and 2' are identically constructed and comprising a housing 21 that rests on a running roller frame 26. The paper output means 1 is also implemented in the same way and provided with running rollers 14. However, the conveying path arrangement 10, 11 and 12 is installed differently in the paper output means 1 than in the following modules 2 and 2'.

The tunnels 4 comprise such a length that they allow an easy refilling of the compartments of the preceding means 1 or of the modules 2 and are strong enough that they can also be walked on as necessary.

A controller 50 may be provided to communicate with every compartment ($A_1$–$D_1$) for coordinating the delivery of paper sheets from the compartment. While shown schematically, the controller 50 may be integrated into the single sheet printer 9 or one of the paper output devices 1, 2, 2'.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A paper feeder for a single sheet printer, the paper feeder comprising:

a first paper output device including a plurality of paper compartments and a first conveying path, said plurality of paper compartments including a drive mechanism for delivering a sheet of paper to the first conveying path, the first conveying path being constructed to convey the sheet of paper to the single sheet printer, the first conveying path being connected to a first branching portion, the first branching portion being connected to a first paper acceptance station, the first paper output device being connected to a second paper output device at the first paper acceptance station, the second paper output device including a plurality of paper compartments, the plurality of paper compartments of the second paper output device including a drive mechanism for delivering a sheet of paper to the first paper acceptance station.

2. The paper feeder of claim 1, wherein the second paper output device further includes a module conveying path constructed to receive the paper sheet from the plurality of paper compartments of the second paper output device, the module conveying path being connected to a paper sheet delivery station that is connected to the first paper acceptance station.

3. The paper feeder of claim 2, wherein the module conveying path is connected to a throughput path, the throughput path connecting the paper sheet delivery station to a second paper acceptance station, the second paper output device being connected to a third paper output device at the second paper acceptance station.

4. The paper feeder of claim 3, further comprising: a fourth paper output device connected to the third paper output device.

5. The paper feeder of claim 2, further comprising:

a flat connecting tunnel disposed between the paper sheet delivery station and the first paper acceptance station, the flat connecting tunnel connecting the paper sheet delivery station to the first paper acceptance station.

6. The paper feeder as claimed in claim 5, wherein said flat conveying tunnel is adjacent a floor to provide walking access thereover.

7. The paper feeder of claim 1, further comprising:

a controller for activating and deactivating the drive mechanisms of the plurality of paper compartments of the first and second paper output devices.

8. A paper feeder as claimed in claim 1, wherein said first paper output device and said second paper output device have a same number of paper compartments.

9. The paper feeder as claimed in claim 1, wherein said first paper output device includes a paper conveying path portion constructed to convey paper sheet upwardly from said first paper acceptance station, and said second paper output device includes a paper conveying path portion constructed to convey paper sheet downwardly to said first paper acceptance station.

10. A method of equipping a single-sheet printer with multiple paper feeders, the method comprising the steps of:

providing a first paper output device having a plurality of paper compartments and a first conveying path, the plurality of paper compartments including a drive mechanism for delivering a sheet of paper to the first conveying path, the first conveying path being constructed to convey the sheet of paper to the single sheet printer, the conveying path being connected to a first branching portion, the first branching portion being connected to a first paper acceptance station, providing a second paper output device at the first paper acceptance station, the second paper output device including a plurality of paper compartments, the plurality of paper compartments of the second paper output device having a drive mechanism for delivering a sheet of paper to the first paper acceptance station, the second paper output device further including a module conveying path constructed to receive the paper sheet from the paper compartment of the second paper output device, the module conveying path being connected to a paper sheet delivery station that is connected to the first paper acceptance station, connecting the first conveying path of the first paper output device to the printer, and connecting the module conveying path of the second paper output device to the first paper acceptance station of the first paper output device.

11. A paper feeder for a single sheet printer, the paper feeder comprising:

a first paper output device including a plurality of paper compartments and a first conveying path, said plurality of paper compartments including a drive mechanism for delivering a sheet of paper to the first conveying path, the first conveying path being constructed to convey the sheet of paper to the single sheet printer, the first conveying path being connected to a first branching portion, the first branching portion being connected to a first paper acceptance station, the first paper output device being connected to a second paper output device at the first paper acceptance station, the second paper output device including a plurality of paper compartments, the plurality of paper compartments of the second paper output device including a drive mechanism for delivering a sheet of paper to the first paper acceptance station, the second paper output device further includes a module conveying path constructed to receive the paper sheet from the plurality of paper compartments of the second paper output device, the module conveying path being connected to a paper sheet delivery station that is connected to the first paper acceptance station, a flat connecting tunnel disposed between the paper sheet delivery station and the first paper acceptance station, the flat connecting tunnel connecting the paper sheet delivery station to the first paper acceptance station and covering said module conveying path, the flat connecting tunnel being disposed adjacent a floor and being strong enough to walk on.

12. A paper feeder as claimed in claim 11, wherein said first paper output device includes a first paper path portion connected to carrying paper sheet in an upward direction from said module conveying path at said flat connecting tunnel, and said second paper output device includes a second paper path portion connected to carry paper sheet in a downward direction to said module conveying path at said flat connecting tunnel so that paper is conveyed downward in said second paper output device to said flat connecting tunnel and conveyed upward in said first paper output device from said flat connecting tunnel.

* * * * *